United States Patent [19]

Woerpel

[11] 4,200,228

[45] Apr. 29, 1980

[54] SNOW MAKING

[76] Inventor: Marvin D. Woerpel, 4833 Holiday Dr., Madison, Wis. 53711

[21] Appl. No.: 943,572

[22] Filed: Sep. 18, 1978

[51] Int. Cl.[2] ..... F25C 3/04

[52] U.S. Cl. ..... 239/25

[58] Field of Search ..... 239/25, 14, 2 R, 25; 62/347, 74, 112

[56] References Cited

U.S. PATENT DOCUMENTS 3,494,559 2/1970 Skinner ..... 239/25

3,596,476 8/1971 Jakob et al. ..... 239/25

FOREIGN PATENT DOCUMENTS 1599765 7/1970 France ..... 239/25

*Primary Examiner*—James B. Marbert

*Attorney, Agent, or Firm*—McDougall, Hersh & Scott

[57] ABSTRACT

Snow making in which ice nucleating microorganisms are incorporated into the water to initiate crystallization when the water is introduced as fine droplets into the atmosphere which is at a temperature below freezing.

7 Claims, No Drawings

SNOW MAKING

This invention relates to snow making and to a method for producing snow.

The demand for snow has increased steadily with the vast increase in the number of people involved in skiing, sledding and the like sports activities. This need is especially acute at times when an insufficient supply of snow, particularly fresh powdered snow, is not available at winter resorts because of adverse weather conditions for making snow in the natural way. It has been common practice to produce snow at such winter resorts for skiing, sledding and the like by means of atomization of water into fine droplets when ambient weather conditions are suitable for cooling the droplets to a temperature below the freezing point of water before the droplets reach the ground. In U.S. Pat. No. 2,968,164, description is made of a process wherein use is made of a propeller for creating a large movement of air at 30° F. or below and for projecting a spray of water into the moving air whereby substantially all of the droplets become at least partially crystallized as snow before reaching the ground or other surface.

This process, which appears to be simple and easy to perform, is in reality a costly and difficult process by reason of the inherent characteristics of water to supercool and remain in a liquid state even when reduced to a temperature as low as −20° F. The extent to which any liquid droplet will supercool is a function of its purity and there are few impurities suspended in water droplets other than ice crystals themselves, which will initiate water crystallization at temperatures above 17° F. On the other hand, the presence of impurities in water often has the effect of lowering the actual freezing point temperature.

Various techniques have been adopted by the industry to achieve supercooling of at least some atomized water droplets in order to initiate crystallization and to utilize the ice crystals formed to "seed" other of the water droplets. In U.S. Pat. No. 3,774,842 and U.S. Pat. No. 3,774,843, description is made of a technique wherein utilization is made of the cooling effect of expanding air. The adiabatic expansion of air across the orifice of a nozzle operates to cool the immediate zone at the nozzle tip to a temperature low enough to initiate ice crystal formation in water droplets atomized by the expanding air. In U.S. Pat. No. 3,567,117, U.S. Pat. No. 3,703,991, and U.S. Pat. No. 3,733,029, description is made of another technique wherein expansion of a liquified gas, such as propane, is utilized to achieve local supercool temperatures for ice nucleation.

Such techniques are confronted with high cost in making compressed air or gas available in sufficient quantity for use in snow making to make up for deficiencies in snow available from natural snowfall and/or any deficiency in the quality of the snow on the ground.

It is an object of this invention to provide a new and improved material and method for snow making which is not subject to the high cost of the snow making process previously employed; which materially reduces the amount of energy consumed in the materials used for snow making and in the process for making snow; and wherein ice nucleation can be achieved at temperatures above that heretofore required, with the result that snow making becomes feasible at higher temperatures and higher humidity as compared to the conditions required for use with the present process.

It has been found, in accordance with the practice of this invention, that the process for making snow can be materially enhanced by providing for the presence of ice nucleating microorganisms in at least some of the water droplets formed by normal snow making operations of the type heretofore described. The presence of such ice nucleating microorganisms in the water droplets initiates ice formation and tends to form snow crystals without the need to supercool the water by the amount heretofore required. For example, with such ice nucleating organisms, snow can be made from water droplets at air temperatures as warm as within the range of 18° to 32° F., somewhat independent of relative humidity, but preferably within the range of 65% to 100% relative humidity. The ice nucleating organisms can also be used to advantage at lower air temperatures although presently used methods are increasingly effective as the air temperature decreases below about 17° F.

By reason of the presence of such ice nucleating organisms in the water droplets, snow can be made at unexpectedly high rates of water flow even without the use of compressed air, compressed gas, or other special localized cooling techniques.

It is not necessary for each and every water droplet to contain ice nucleators. In prior practice, it has been found to be sufficient if only a few percent of the water droplets that are formed are supercooled, since crystallization of the remaining droplets will be initiated in response to contact or collision between the ice crystals from the supercooled drops with the others. Thus, in the practice of this invention, it is sufficient if one nucleating organism or cell is present in as little as 2% to 5% of the droplets formed of the water but it is preferred that ice nucleating cells be present in 5% to 100% of the water droplets.

For this purpose, ice nucleating cells can be added to the water before atomization at a concentration within the range of $1\times10^5$ to $1\times10^{13}$ cells per gallon of water, the amount depending on the size of droplets achieved when the water is atomized. For snow making, use can be made of water droplets up to 500 microns ($\mu$) in diameter but it is preferred to made use of droplets of about 150$\mu$ in diameter or less. Atomization as normally accomplished by the various processes for snow making provides water droplets varying in diameter from a few percent below 150$\mu$ to a few percent larger than 500$\mu$ so that the range of 150–500 $\mu$ represents an acceptable mean droplet diameter for use in the manufacture of snow in accordance with the practice of this invention.

Ice nucleating organisms suitable for use in snow making in accordance with the practice of the invention are preferably non-pathogenic and to be selected from cultures which can be easily grown, stable under conditions which permit storage, shipment and dispersal in water pumped to the snow making machine. While not necessary, it may be desirable, particularly if the organism selected is a pathogen, to attenuate the cells or inhibit their reproduction and further growth while still retaining their ice nucleating characteristics.

As used herein, the term "ice nucleating cell" is intended to include the active element of any of the various microorganisms from any source which nucleate ice formation. Literally hundreds of bacteria and other microorganisms exist, some of which are non-ice nucleating and others of which are ice nucleating. It would be impractical to attempt to identify such ice nucleating organisms by name even within a particular genus, since some of the species within the genus will be ice nucleating while others are non-ice nucleating. Even within a species, some isolates will be non-ice nucleating and other isolates will ice nucleate. For example, Leaf Surface Bacterial Ice Nuclei As Incitants of Frost Damage to Corn and Other Plants, PhD Thesis of S. E. Lindow, University of Wisconsin, Madison, Wisconsin, 1977, reports that within 85 strains of the species *P. syringae,* some 81 strains were ice nucleating and only 4 strains were non-ice nucleating, and within *E. herbicola,* some 41 isolates were ice nucleating while only 4 were non-ice nucleating.

As a result, instead of seeking to identify the ice nucleating or other microorganisms by name, the more appropriate manner for their identification for use in the practice of this invention is by way of a test to determine whether or not they fall within the category of ice nucleators. Such a test has been devised by others. Lindow, S. E., Arny, D. C. and Upper, C. D. Phytopathology 68 No. 3, March 1978 for example, present such tests and test results using bacterial suspensions for testing for ice nucleating content.

TESTING MICROORGANISMS FOR ICE NUCLEATION ACTIVITY

A −5° C. test surface was prepared by spraying aluminum foil with a 1% weight/volume (w/v) solution of paraffin in xylene, removing the xylene in a 55° C. circulating oven, foldng the foil into a flat-bottomed boat and floating the boat on a methanolethylene glycol-water solution maintained at −5° in a refrigerated constant temperature bath (P. M. Tamsen Model M45 circulating water bath, P. M. Tamsen N. V., Holland). This bath was cooled with a Neslab model PBC-2 bath cooler (Neslab Instruments, Inc., Portsmouth, New Hampshire). This refrigerated bath, when connected to an auxiliary insulated circulating bath, yielded a total −5° C. working surface of approximately 3000 $cm^2$. Within each bath, the temperature was regulated to about −5° C., with temperature differences between the two baths being less than 0.3° C. Care was required in placing the aluminum boats (ca. 500 $cm^2$ each) on the liquid surface to prevent entrapment of air bubbles between the aluminum and the liquid coolant. Discrete 2–6 day old colonies from agar plates were sampled with a sterile toothpick and the bacterial cells were suspended in approximately 0.1 ml of sterile distilled water to yield a turbid suspension (greater than $10^8$ cells/ml). Five 10 ul droplets of suspension from each colony were placed on the −5° C. test surface. A colony was considered to be ice nucleating if one or more of the five droplets froze within 30 seconds at −5° C.

259 bacterial isolates were tested by Lindow, S. E. for ice nucleating activity at −5° C. with the following results:

| Bacterial Species<br>Isolates active as ice nuclei at −5° C. | (Number of Isolates) |
|---|---|
| *P. syringae* | 81 |
| *P. syringae*-like field isolates | 28 |
| *P. coronafaciens* | 6 |
| *P. pisi* | 4 |
| *P. fluoroscens* | 1 |
| *E. herbicola* | 2 |
| *E. herbicola*-like field isolates | 41 |
| Total ice nucleating active isolates tested | 163 |

Obviously, this test can be modified particularly as to the temperature used to improve the selection of organisms of greater ice nucleating efficiency.

To this time, as far as can be determined, all efforts to improve snowmaking have utilized either mechanical or thermodynamic variations in combining or modifying the two primary constituents: air and water.

This invention for the first time introduces the concept of a water borne nucleating agent, effective in such function at temperatures in the range of 18° F. to 32° F., as an aid in snowmaking. Such agent can be used in the normal compressed air and water snowmaking operation as described above or, perhaps even more importantly, as a substitute for the compressed air.

It has been found that by adding certain ice nucleating organisms to the water prior to its atomization, one can not only make snow under the ambient air temperatures and humidities and at water flow rates in accordance with present practice, but unexpectedly permits higher rates of water flow and, hence, higher rates of snowmaking even without the use of compressed air or other special localized cooling techniques.

By way of example, on a windy winter morning when the air temperature was 19° F. and the humidity was about 60% relative, water at 33° F. was atomized under hydraulic pressure at 2 gpm through a nozzle under 150 psi (gauge) pressure. The atomized droplets did not freeze even though projected from the nozzle 8 feet above the ground. However, when a suspension of bacterial cells of the species *Psuedomonas syringae* were added to the water in a concentration of $1\times10^7$ cells/ml or $4\times10^{10}$ cells/gallon, the droplets were readily converted to ice crystals (snow) even though none of the other conditions were changed.

In the above example, the species *Psuedomonas syringae* can be replaced with equivalent amounts of *Psuedomonas coronafaciens, Psuedomonas pisi, Psuedomonas fluorescens, Erwinia herbicola,* or other ice nucleating microorganisms.

It will be understood that changes may be made in the details of formulation and operation without departing from the spirit of the invention, especially as defined in the following claims.

I claim:

1. A method for snow making comprising incorporating ice nucleating microorganisms in water, introducing the water as fine droplets into the atmosphere at a temperature below freezing whereby the ice nucleating microorganisms initiate crystal formation to form snow.

2. The method as claimed in claim 1 in which at least some of the droplets that are formed contain ice nucleating microorganisms.

3. The method as claimed in claim 1 in which the ice nucleating microorganisms are selected of ice nucleating bacteria.

4. The method as claimed in claim 1 in which the ice nucleating microorganisms are present in the water in an amount within the range of $1\times10^5-1\times10^{13}$ cells/gallon.

5. The method as claimed in claim 1 in which the water is introduced into the atmosphere as droplets having an average diameter within the range of 150–500μ.

6. The method as claimed in claim 1 in which the water containing the nucleating microorganisms is sprayed into the atmosphere.

7. The method as claimed in claim 6 in which the atmosphere is at a temperature within the range of 18°–32° F.

* * * * *